US010065125B1

(12) United States Patent
Wang

(10) Patent No.: US 10,065,125 B1
(45) Date of Patent: Sep. 4, 2018

(54) 3D HIGH-SPEED TRACK CAR TOY

(71) Applicant: Wen-Bo Wang, Shantou (CN)

(72) Inventor: Wen-Bo Wang, Shantou (CN)

( * ) Notice: Subject to any disclaimer, the term of this patent is extended or adjusted under 35 U.S.C. 154(b) by 0 days.

(21) Appl. No.: 15/693,682

(22) Filed: Sep. 1, 2017

(30) Foreign Application Priority Data

May 16, 2017 (CN) ..... 2017 2 0538058 U

(51) Int. Cl.

| | |
|---|---|
| ***A63H 18/02*** | (2006.01) |
| ***A63H 18/04*** | (2006.01) |
| ***A63H 18/10*** | (2006.01) |
| ***A63H 17/26*** | (2006.01) |
| ***A63H 17/14*** | (2006.01) |
| ***A63H 29/22*** | (2006.01) |
| *A63H 18/16* | (2006.01) |

(52) U.S. Cl.
CPC ..... *A63H 18/10* (2013.01); *A63H 17/14* (2013.01); *A63H 17/262* (2013.01); *A63H 18/021* (2013.01); *A63H 18/028* (2013.01); *A63H 18/04* (2013.01); *A63H 29/22* (2013.01); *A63H 2018/165* (2013.01)

(58) Field of Classification Search
CPC ..... A63H 18/00; A63H 18/02; A63H 18/028; A63H 18/04; A63H 18/10; A63H 18/14; A63H 18/16; A63H 2018/165
See application file for complete search history.

(56) References Cited

U.S. PATENT DOCUMENTS

| | | | | | |
|---|---|---|---|---|---|
| 4,357,778 | A * | 11/1982 | Matsumoto | A63H 18/04 | 104/55 |
| 4,429,488 | A * | 2/1984 | Wessels | A63H 18/10 | 104/305 |
| 4,940,444 | A * | 7/1990 | Russell | A63H 18/12 | 104/281 |
| 5,118,320 | A * | 6/1992 | Miller | A63H 18/02 | 104/245 |
| 2005/0287915 | A1* | 12/2005 | Sheltman | A63H 18/025 | 446/444 |
| 2006/0276102 | A1* | 12/2006 | Dieckmann | A63H 17/36 | 446/444 |
| 2007/0209543 | A1* | 9/2007 | Beaulieu | A63F 7/3622 | 104/53 |
| 2016/0310857 | A1* | 10/2016 | Effler | A63H 18/08 | |

* cited by examiner

*Primary Examiner* — John Ricci
(74) *Attorney, Agent, or Firm* — Rosenberg, Klein & Lee

(57) ABSTRACT

A 3-dimensional high-speed track car toy comprises a track body and a toy car. Straight tracks, curved tracks, centripetal tracks and centrifugal tracks are assembled to form a 3-dimensional closed track. The track body stands on the ground fixedly through support rods and support seats. The track body is paved with a track along which the toy car runs. Components of the track body have fastener-containing groove structures to fix an iron axis onto the track. The toy car is placed on the track body. The track is equipped with an iron axis. The bottom of the toy car is equipped with magnets. Thereby, a sufficient attractive force is generated to overcome gravity of the toy car. Therefore, the toy car can run on the track disposed on a ceiling or a vertical wall. Thus, the user can enjoy more amusement from playing the present invention.

8 Claims, 4 Drawing Sheets

3D HIGH-SPEED TRACK CAR TOY

This application claims priority for China patent application no. 201720538058.0 filed on May 16, 2017, the content of which is incorporated by reference in its entirety.

BACKGROUND OF THE INVENTION

Field of the Invention

The present invention relates to a track car toy, particularly to a novel 3D high-speed track car toy.

Description of the Related Art

There are various types of track car toys available in the market. The conventional track car toys only have simple performance, wherein the toy car runs on a standard track, driven in a circular track by inertia and centrifugal force. There is also a type of track car toy whose chassis is equipped with magnets and whose track is paved with a steel strip. The assemblage of the track car toy is very complicated. The toy car thereof is very likely to head up and run out of the track while passing an everted track because one magnet is installed in an area outside the central line of the front wheels and the other magnet is installed in an area behind the central line of the rear wheels. Therefore, the toy car thereof can only run slowly in an annular track. There is also a type of track car toy available in the market, wherein the toy car has wheels on the top and bottom sides thereof and is able to run inside a sealed track vertically. While the toy car is driven by a motor, the friction force between the sealed track and two sides of wheels enables the toy car to surmount the gravity and run vertically. This type of track car toy is very complicated in structure because both the top and bottom sides of the toy car need equipping with wheels. Besides, the toy car cannot run in a track turning 180 degrees. Because of using the sealed track, the material cost and assemblage cost of this type of track car toy is very high.

Accordingly, the present invention proposes a novel 3D high-speed track car toy to solve the abovementioned conventional problems.

SUMMARY OF THE INVENTION

The present invention is realized by the following technical schemes:

A novel 3D high-speed track car toy comprises a track body and a toy car. In the track body, straight tracks, curved tracks, centripetal tracks and centrifugal tracks are assembled to form a 3D closed track. The track body stands on the ground fixedly through support rods and support seats. The track body is paved with a track along which the toy car runs. The components of the track body have fastener-containing groove structures to fix an iron axis onto the track. The toy car is placed on the track body.

In a preferred embodiment, flexible manually-bendable members are disposed in the joints of the straight tracks, curved tracks, centripetal tracks and centrifugal tracks; the flexible manually-bendable members can be bent to a given angle and can automatically restore their original positions; each two flexible manually-bendable members are fixed by a connection fastener and connected to each other by the connection fastener.

In a preferred embodiment, a magnet A and a magnet B are respectively disposed in appropriate positions of the central axes of the front wheels and the rear wheels of the toy car; the magnets A and the magnet B are exactly corresponding to the iron axis disposed on the track body to generate two downward sucking forces.

In a preferred embodiment, the rear wheels of the toy car adopt an originally-innovative arc wheel surface with only a narrow strip of wheel surface used to generate track adhesion.

In a preferred embodiment, the toy car includes a driving mechanism, a chassis carrying two cylindrical-shaped magnets, batteries, a front-wheel steering mechanism, and a case structure; the driving mechanism includes a high-speed motor and a low-gear ratio transmission mechanism; the toy car also has a circuit board; the circuit board has a power switch and a gearshift switch; the gearshift switch shifts between a high gear and a low gear to adjust the speed of the toy car arbitrarily.

In a preferred embodiment, the track of the track body is made of a material having a given elasticity and has a groove in the middle; a plurality of fasteners for fixing the iron axis is disposed in the groove.

In a preferred embodiment, each track engagement face of the track body has a locking protrusion; the support seat has a press-fit socket and a press-fit hook; the dimensions of the press-fit socket and the press-fit hook match the dimensions of the locking protrusion; two ends of the support seat have grip fasteners for sleeving and gripping the support rods or support legs.

In a preferred embodiment, the front-wheel steering mechanism of the toy car includes a rotation point A and a rotation point B; the rotation point B functions as the rotation support point of the front-wheel steering mechanism while the toy car is turning the direction; a rotation-sliding slot is formed in the position where the rotation point A is located; while the toy car is backing, the friction of the front wheels makes the front wheels turn and makes the rotation point A inside the rotation-sliding slot move along the rotation-sliding slot to enable the toy car to change the driving direction while backing and enable the toy car to run even in a track-free environment.

In comparison with the existing technology, the present invention has the following advantages: the novel track of the present invention is equipped with an iron axis, and the bottom of the toy car cooperating with the track is equipped with magnets, whereby is generated a sufficient attractive force to overcome the gravity of the toy car, wherefore the toy car can run on the track disposed on a ceiling or a vertical wall, and wherefore the user can enjoy more amusement from playing the present invention; as the magnets are respectively disposed in the middle regions of the central axes of the front wheels and the rear wheels, the toy car is stably and firmly sucked onto the track, exempted from head-up or tail-up caused by unbalanced sucking force; the rear wheels adopt an originally-innovative design of arc wheel surface with only a narrow strip of wheel surface used to generate track adhesion, whereby the wheel surface would not scrape against the track while the toy car is turning its direction, wherefore the width of the track can be significantly decreased to occupy less space, and wherefore the scrape-free design of the wheel surface enables the toy car to run through a curved track stably at a high speed.

Below, embodiments are described in detail in cooperation with the attached drawings to make easily understood the characteristics and efficacies of the present invention.

DETAILED DESCRIPTION OF THE INVENTION

Below, embodiments are described in detail in cooperation with the attached drawings to further demonstrate the present invention.

Figure 1:
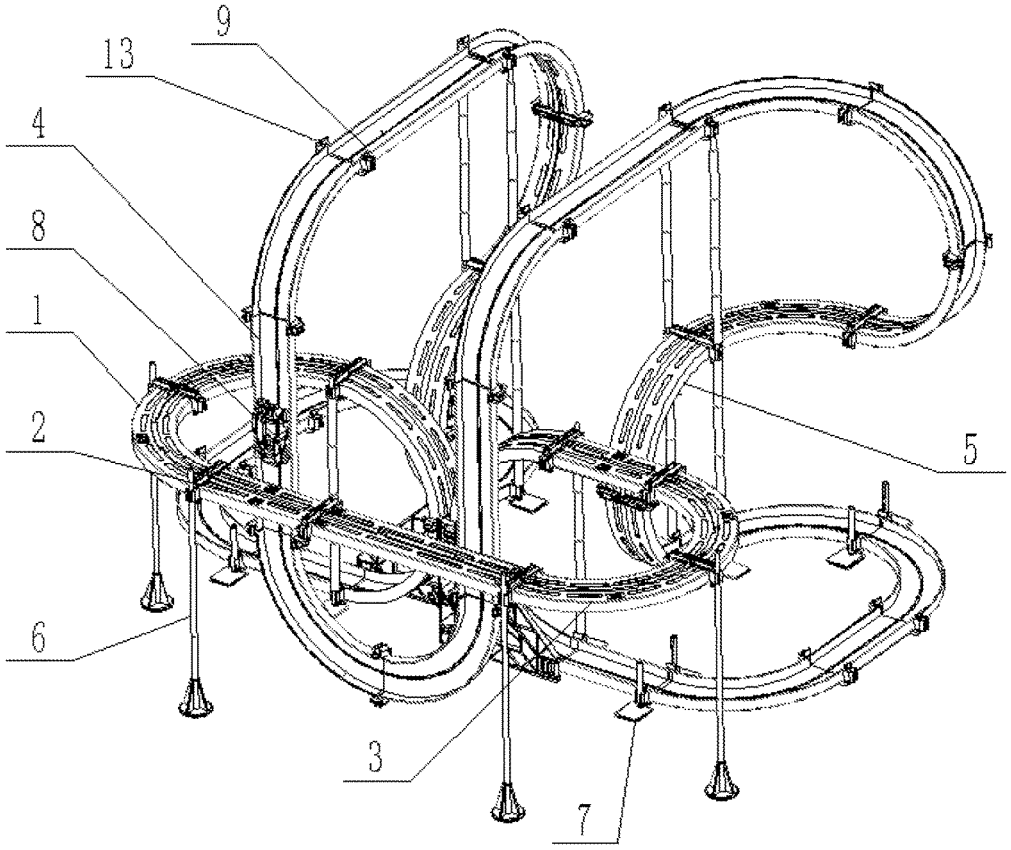
FIG. 1 is a perspective view schematically showing the structure of a track body according to one embodiment of the present invention.
Figure 2:
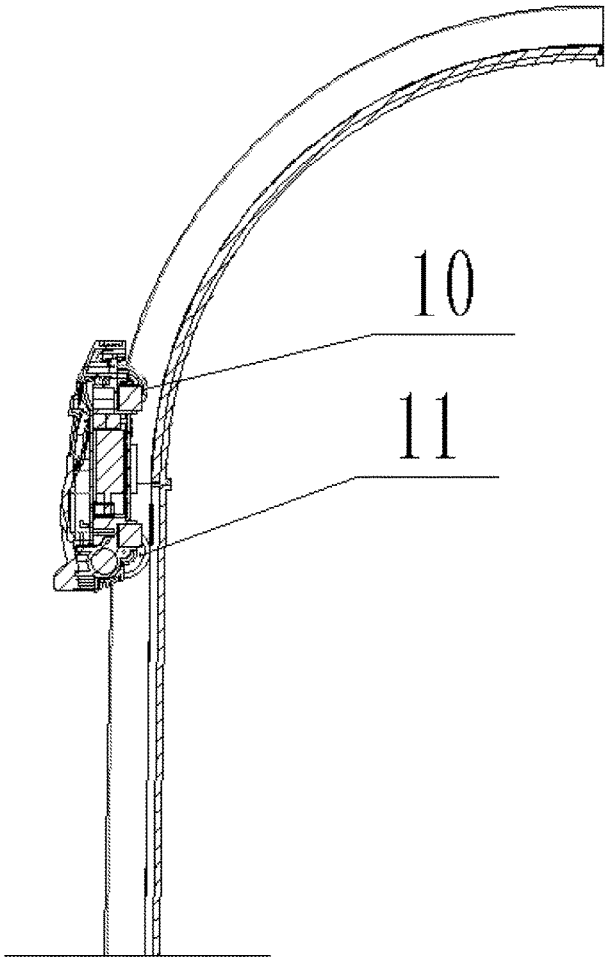
FIG. 2 is a diagram schematically showing the assemblage of a toy car and a track body according to one embodiment of the present invention.
Figure 3:
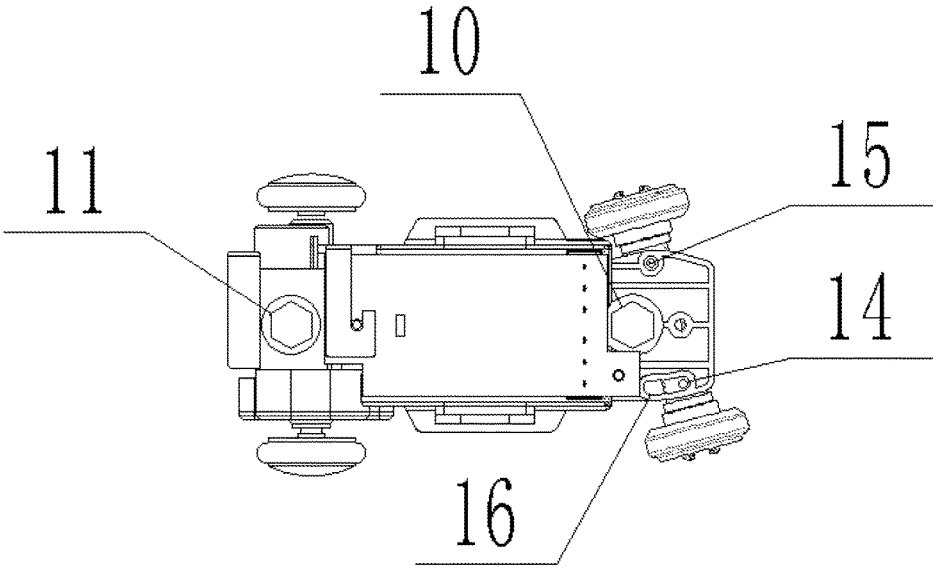
FIG. 3 is a bottom view schematically showing a toy car according to one embodiment of the present invention.
Figure 4:
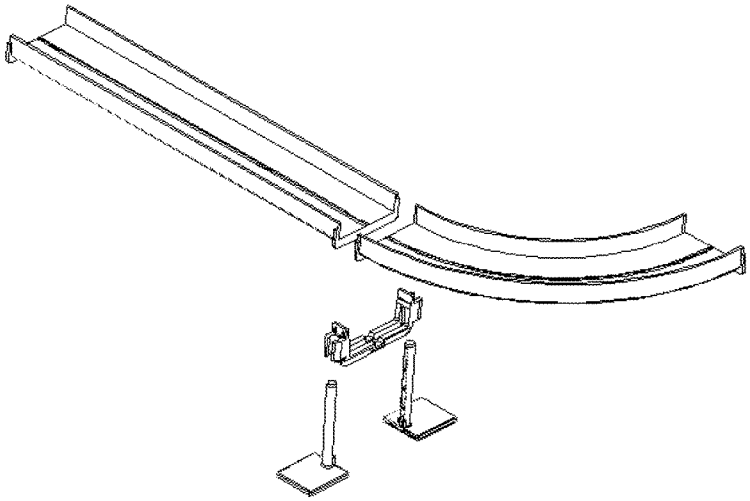
FIG. 4 is an exploded view schematically showing a support seat according to one embodiment of the present invention.
Figure 5:
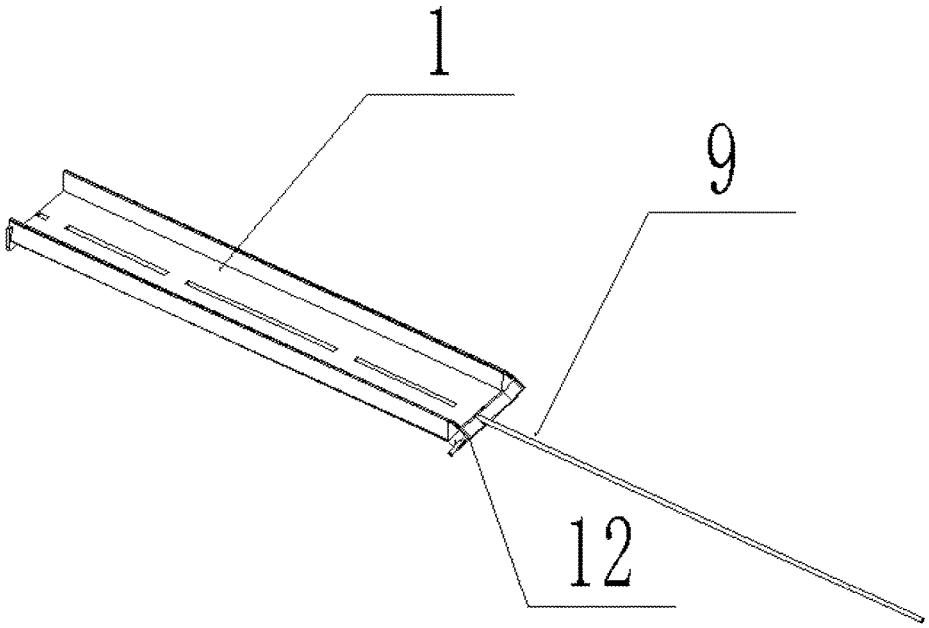
FIG. 5 is a diagram schematically showing the rotation of a flexible manually-bendable member of a track body according to one embodiment of the present invention.
Figure 6:
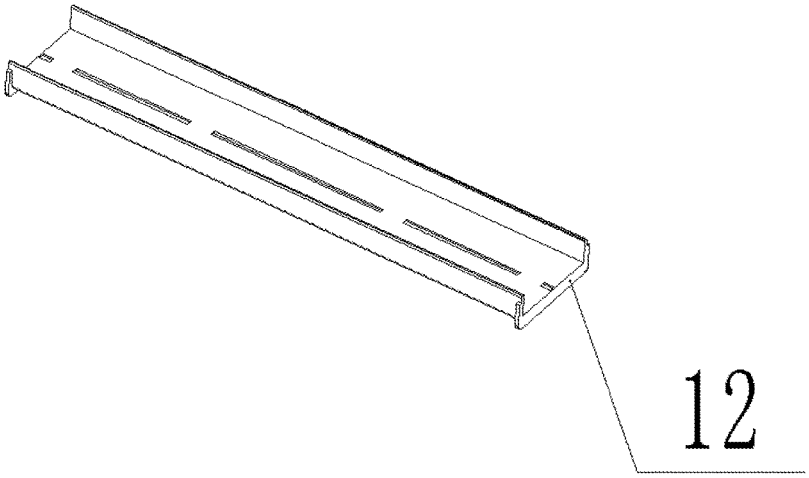
FIG. 6 is a diagram schematically showing the position restoring of a flexible manually-bendable member of a track body according to one embodiment of the present invention.

Refer to FIGS. 1-6. A novel 3D high-speed track car toy comprises a track body 1 and a toy car 8. In the track body 1, straight tracks 2, curved tracks 3, centripetal tracks 5 and centrifugal tracks 4 are assembled to form a 3D closed track. The track body 1 stands on the ground fixedly through support rods 6 and support seats 7. The track body 1 is paved with a track along which the toy car 8 runs. The components of the track body 1 have fastener-containing groove structures to fix an iron axis 9 onto the track. The toy car 8 is placed on the track body 1. Flexible manually-bendable members 12 are disposed in the joints of the straight tracks 2, curved tracks 3, centripetal tracks 5 and centrifugal tracks 4. The flexible manually-bendable members 12 can be bent to a given angle and can automatically restore their original positions. Each two flexible manually-bendable members 12 are fixed by a connection fastener 13 and connected to each other by the connection fastener 13. A magnets A 10 and a magnet B 11 are respectively disposed in appropriate positions of the central axes of the front wheels and the rear wheels of the toy car. The magnets A 10 and B 11 are exactly corresponding to the iron axis 9 disposed on the track body 1 to generate two downward sucking forces. The rear wheels of the toy car 8 adopt an originally-innovative arc wheel surface with only a narrow strip of wheel surface used to generate track adhesion. The toy car 8 includes a driving mechanism, a chassis carrying two cylindrical-shaped magnets, batteries, a front-wheel steering mechanism, and a case structure. The driving mechanism includes a high-speed motor and a low-gear ratio transmission mechanism. The toy car 8 also has a circuit board. The circuit board has a power switch and a gearshift switch. The gearshift switch shifts between a high gear and a low gear to adjust the speed of the toy car 8 arbitrarily. The track of the track body is made of a material having a given elasticity and has a groove in the middle. A plurality of fasteners is disposed in the groove for fixing the iron axis 9. Each track engagement face of the track body has a locking protrusion. The support seat 7 has a press-fit socket and a press-fit hook. The dimensions of the press-fit socket and the press-fit hook match the dimensions of the locking protrusion. The support seat 7 has grip fasteners for sleeving and gripping the support rods or support legs. The front-wheel steering mechanism of the toy car 8 includes a rotation point A 14 and a rotation point B 15. The rotation point B 15 functions as the rotation support point of the front-wheel steering mechanism while the toy car 8 is turning the direction. A rotation-sliding slot 16 is formed in the position where the rotation point A 14 is located. While the toy car 8 is backing, the friction of the front wheels makes the front wheels turn and makes the rotation point A 14 inside rotation-sliding slot 16 move along the rotation-sliding slot 16. Thereby, the toy car 8 can change the driving direction while backing. Although the design is inexpensive, it enables the toy car 8 to run even in a track-free environment.

In one embodiment, the novel track of the present invention is equipped with an iron axis 9, and the bottom of the toy car 9 cooperating with the track is equipped with magnets, whereby is generated a sufficient attractive force to overcome the gravity of the toy car 8, wherefore the toy car 8 can run on the track disposed on a ceiling or a vertical wall. Thus, the user can enjoy more amusement from playing the present invention. As the magnets are respectively disposed in the middle regions of the central axes of the front wheels and the rear wheels, the toy car 8 is stably and firmly sucked onto the track, exempted from head-up or tail-up caused by unbalanced sucking force. The present invention adopts an originally-innovative arc wheel surface of the rear wheels, leaving only a narrow strip of wheel surface for track adhesion. Thereby, the wheel surface would not scrape against the track while the toy car 8 is turning its direction. Thus, the width of the track can be significantly decreased to occupy less space. Further, the scrape-free design of the wheel surface enables the toy car 8 to run through a curved track stably at a high speed. The way that the magnets are distributed on the chassis maintains the vertical sucking force at a maximum value and obviously enhances the stability of the toy car 8 while the toy car 8 is running on a vertical track or around a curved track, or even rushing through a centrifugal track at a high speed. At the instant the toy car 8 rushes out of the straight track, the sucking force of the magnet A 10 makes the head of the toy car 8 turn its direction along the centrifugal track 4. As the magnet B 11 of the rear wheels is in line with the magnet A 10, the rear wheels would not fly out of the track but run along the centrifugal track 4 also. The design of the arc wheel surface of the rear wheels prevents the wheel surface from scraping against the track and prevents the toy car 8 from running out of the track while the toy car 8 is passing an acute curved track. The arc-surface design of the rear wheels also significantly decreases the width of the track. The present invention adopts a unique design of the front-wheel steering mechanism: while the toy car 8 is backing, the friction of the front wheels makes the front wheels turn. Thereby, the toy car 8 can change the driving direction while backing. Although the design is inexpensive, it enables the user to play the toy car 8 even in a track-free environment.

The principles, characteristics, and advantages of the present invention have been demonstrated above. It should be understood by the persons skilled in the art: the embodiments described above are only to exemplify the present invention but not to limit the scope of the present invention. Variations and improvements of the embodiments according to the spirit of the present invention are still within the scope of the present invention, which is based on the claims stated below.

What is claimed is:

1. A 3-dimensional high-speed track car toy comprising a track body and a toy car, wherein straight tracks, curved tracks, centripetal tracks and centrifugal tracks are assembled to form a 3-dimensional closed track; said track body stands on the ground fixedly through support rods and support seats; said track body is paved with a track along which said toy car runs; components of said track body have fastener-containing groove structures to fix an iron axis onto said track; said toy car is placed on said track body.

2. The 3-dimensional high-speed track car toy according to claim 1, wherein flexible manually-bendable members are disposed in joints of said straight tracks, said curved tracks, said centripetal tracks and said centrifugal tracks; said flexible manually-bendable members can be bent to a given angle and can automatically restore their original positions; each two said flexible manually-bendable members are fixed by a connection fastener and connected to each other by said connection fastener.

3. The 3-dimensional high-speed track car toy according to claim 1, wherein a magnet A and a magnet B are respectively disposed in appropriate positions of central axes of front wheels and rear wheels; said magnet A and said magnet B are exactly corresponding to said iron axis disposed on said track body to generate two downward sucking forces.

4. The 3-dimensional high-speed track car toy according to claim 1, wherein an arc wheel surface design is used in rear wheels of said toy car with only a narrow strip of wheel surface used to generate track adhesion.

5. The 3-dimensional high-speed track car toy according to claim 1, wherein said toy car includes a driving mechanism, a chassis carrying two cylindrical-shaped magnets, batteries, a front-wheel steering mechanism, and a case structure; said driving mechanism includes a high-speed motor and a low-gear ratio transmission mechanism; said toy car also has a circuit board; said circuit board has a power switch and a gearshift switch; said gearshift switch shifts between a high gear and a low gear to adjust speed of said toy car arbitrarily.

6. The 3-dimensional high-speed track car toy according to claim 5, wherein said front-wheel steering mechanism of said toy car includes a rotation point A and a rotation point B; said rotation point B functions as a rotation support point of said front-wheel steering mechanism while said toy car is turning its direction; a rotation-sliding slot is formed in a position where said rotation point A is located; while said toy car is backing, friction of front wheels makes front wheels turn and makes said rotation point A inside said rotation-sliding slot move along said rotation-sliding slot to enable said toy car to change its driving direction while backing and enable said toy car to run even in a track-free environment.

7. The 3-dimensional high-speed track car toy according to claim 1, wherein said track of said track body is made of a material having a given elasticity and has a groove in a middle of said track; a plurality of fasteners for fixing said iron axis is disposed in said groove.

8. The 3-dimensional high-speed track car toy according to claim 1, wherein each track engagement face of said track body has a locking protrusion; said support seat has a press-fit socket and a press-fit hook; dimensions of said press-fit socket and said press-fit hook match dimensions of said locking protrusion; said support seat has grip fasteners for sleeving and gripping said support rods or support legs.

* * * * *